US006742251B1

(12) United States Patent
Fukase

(10) Patent No.: US 6,742,251 B1
(45) **Date of Patent: *Jun. 1, 2004**

(54) METHOD OF CRIMPING A TERMINAL ONTO AN ELECTRICAL WIRE EQUIPPED WITH A WATER-PROOF PLUG USING A POSITIONING MEANS

(75) Inventor: Yoshihiro Fukase, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/041,677

(22) Filed: Mar. 13, 1998

(30) Foreign Application Priority Data

Mar. 18, 1997 (JP) ..... P.9-064887

(51) Int. Cl.[7] ..... H01R 43/04

(52) U.S. Cl. ..... 29/863; 29/754; 29/450; 29/861; 29/862; 29/881; 29/751; 29/753

(58) Field of Search ..... 29/863, 564.4, 29/564.6, 755, 33 M, 754, 450, 86, 881, 882; 174/87, 77 R, 94 R; 439/587, 274

(56) References Cited

U.S. PATENT DOCUMENTS

| | | | | | |
|---|---|---|---|---|---|
| 4,375,229 | A | * | 3/1983 | Mikami et al. | 140/102 |
| 4,383,364 | A | * | 5/1983 | Casey | 29/863 |
| 4,641,428 | A | * | 2/1987 | Anderson | 29/863 |
| 4,653,182 | A | * | 3/1987 | Fukuda et al. | 29/754 |
| 4,765,052 | A | * | 8/1988 | Fukuda et al. | 29/450 |
| 4,979,291 | A | * | 12/1990 | Phillips et al. | 29/863 |
| 5,351,385 | A | * | 10/1994 | Takano | 29/450 |
| 5,404,634 | A | * | 4/1995 | Takeshita et al. | 29/564.4 |
| 5,532,433 | A | * | 7/1996 | Endo et al. | 174/84 C |
| 5,575,061 | A | * | 11/1996 | Tsuji et al. | 29/863 |
| 5,743,002 | A | * | 4/1998 | Ito et al. | 29/754 |
| 5,926,947 | A | * | 7/1999 | Takano et al. | 29/754 |

FOREIGN PATENT DOCUMENTS

| | | |
|---|---|---|
| EP | 0 410 416 A2 | 1/1991 |
| JP | Hei. 3-5029 | 3/1991 |
| JP | 4-74867 | 6/1992 |
| JP | 07245169 | 9/1995 |
| JP | 07312813 | 11/1995 |
| JP | 07326457 | 12/1995 |
| JP | 9-161938 | 6/1997 |

* cited by examiner

*Primary Examiner*—Carl J. Arbes
*Assistant Examiner*—Minh Trinh
(74) *Attorney, Agent, or Firm*—Sughrue Mion, PLLC

(57) ABSTRACT

An apparatus is provided that crimps an electrical wire having a water-proof plug onto a connector terminal in a given positional relationship and can be applied to an automatic assembling operation. In the vicinity of upper crimping members and lower crimping members of the apparatus which crimp an electrical wire having a water-proof plug onto the connector terminal, there are provided a water-proof plug positioning member which has a positioning protuberance used for placing a water-proof plug in a given position with respect to the front end of the connector terminal and a terminal positioning member which is vertically movable and engages with a positioning groove of the connector terminal. The front end face of a water-proof plus sealing section is brought into contact with the rear surface of a positioning protuberance, thereby placing the water-proof plug in a predetermined position. The upper surface of the positioning protuberance is formed into a concave circular-arch surface having the same radius as that of a water-proof plug cylindrical portion. The water-proof plug positioning member is provided so as to be able to vertically move while remaining in slidable contact with the rear surface of the lower crimping member.

8 Claims, 3 Drawing Sheets

METHOD OF CRIMPING A TERMINAL ONTO AN ELECTRICAL WIRE EQUIPPED WITH A WATER-PROOF PLUG USING A POSITIONING MEANS

BACKGROUND OF THE INVENTION

The present invention relates to a method of crimping an electrical wire equipped with a water-proof plug, such as a rubber plug, onto a connector terminal, as well as to a terminal crimping apparatus. More particularly, the present invention relates to a method of crimping an electrical wire and a water-proof plug onto a connector terminal by placing a connector terminal, an electrical wire, and a water-proof plug into a predetermined layout of positions, as well as to a terminal crimping apparatus.

As shown in FIG. 1, a connector terminal 42 is generally crimped onto the metal-core-exposed front end and the sheathed end of an electrical wire 41 equipped with a water-proof plug 40 made of an elastic member such as rubber. The front end of the connector terminal 42 is fitted into a given mount hole formed in an unillustrated housing. At this time, the water-proof plug 40 is brought into pressed contact with the internal surface of the mount hole of the housing, thereby ensuring the sealing characteristics of the connector terminal 42 and the electrical wire 41.

As shown in FIGS. 1 and 2, a conventional apparatus 45 used for crimping an electrical wire equipped with a water-proof plug onto a terminal crimps the metal-core-exposed front end and the sheathed end of the electrical wire 41 equipped with the water-proof plug 40 to the connector terminals 42, respectively. The terminal crimping apparatus 45 is provided with an electrical wire/terminal positioning member 47 which holds the connector terminal 42 in a given position with respect to a pair of crimping members; namely, an upper crimping member 46*a* and a lower crimping member 46*b*. the upper crimping member 46*a* is called "a crimper" and is vertically movable. The lower crimping member 46*b* is called "an anvil" and is fixed on a base. Pressing force is exerted onto a given point of the connector terminal 42 from above, to thereby elastically deform an area to be crimped. As a result, the electrical wire 41 and the water-proof plug 40 are crimped onto and connected to the connector terminal 42.

At this time, the electrical wire/terminal positioning member 47 brings the metal core end of the front end of the electrical wire 41 inserted into the connector terminal 42 to a side surface 48, as well as bringing the rear end of a connecting portion of the connector terminal 42 into contact with another side surface 49. As a result, the electrical wire 41 and the connector terminal 42 are held in given positions with respect to the upper and lower crimping members 46*a*, 46*b*.

In the foregoing conventional terminal crimping apparatus 45, the electrical wire 41 and the connector terminal 42 are held in position with respect to the upper and lower crimping members 46*a*, 46*b*. However, the water-proof plug 40 cannot be positioned.

For this reason, a housing cavity arises in the space between the rear end of the water-proof plug 40 in its insertion direction and the open end face of the mount hole formed in the housing when the connector terminal 42 is fitted into the mount hole of the housing. A water puddle is formed in the housing cavity, thereby impairing the water-proof characteristics of the housing.

For this reason, as shown in FIG. 1, in order to prevent a housing cavity when the rear end of the water-proof plug 40 is brought into alignment in its insertion direction with the open end face of the mount hole of the housing, dimension L defined by a given positional relationship of the connector terminal 42, the electrical wire 41, and the water-proof plug 40 must be set to a given value. More specifically, the dimension L has a major effect on the sealing characteristics of the housing, and there is a need to strictly control the positional relationship of the connector terminal 42, the electrical wire 41, and the water-proof plug 40, thereby resulting in a decrease in the efficiency of a crimping operation.

Although the electrical wire 41 is positioned by bringing the front end of the metal core into contact with the side surface 48 of the electrical wire/terminal positioning member 47, the electrical wire cannot be correctly positioned through an automatic assembling operation because of the extremely-low rigidity of the metal core.

SUMMARY OF THE INVENTION

It is an object of the present invention to provide a method and an apparatus, both of which place in a given positional relationship a connector terminal, an electrical wire crimped onto the connector terminal, and a water-proof plug attached to the electrical wire and are capable of being applied to an automatic assembling operation.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

These objects can be accomplished by a method of crimping an electrical wire equipped with a water-proof plug onto a terminal and a terminal crimping apparatus as defined below.

According to one aspect of the present invention, there is provided a crimping method of crimping a connector terminal onto an electrical wire equipped with an elastic water-proof plug, comprising the step of:

placing the water-proof plug in a predetermined position with respect to the front end of the connector terminal through use of positioning means.

Preferably, the electrical wire having the water-proof plug set thereon approaches the connector terminal from behind and is placed in a predetermined position through use of the positioning means.

According to another aspect of the present invention, there is provided a crimping apparatus for crimping a connector terminal onto an electrical wire equipped with an elastic water-proof plug, comprising:

a water-proof plug positioning member having a positioning protuberance used for the purpose of placing the water-proof plug in a given position with respect to the front end of the connector terminal; and a pair of upper crimping members and a pair of lower crimping members, both of which are positioned in the vicinity of the water-proof plug positioning member and crimp the connector terminal in a given position on the electrical wire.

Preferably, the crimping apparatus further comprises a terminal positioning member which places the connector terminal in a predetermined position with respect to the upper and lower crimping members by bringing a given area of the connector terminal substantially into contact with both sides of the terminal positioning member.

More preferably, a front portion of the water-proof plug is formed into a water-proof plug cylindrical portion, and a rear portion of the water-proof plug cylinder is formed into a water-proof plug sealing portion which is larger in diameter than the water-proof plug cylindrical portion and includes a desired number of seal rings, and the front end face of the water-proof plug cylindrical portion is brought into contact with the rear surface of the positioning protuberance. Further, a circular-arc surface which has the same radius as that of the water-proof cylindrical portion is formed on the upper surface of the positioning protuberance.

Further preferably, the positioning protuberance is formed on the upper surface of the water-proof plug positioning member, and the water-proof plug positioning member is provided so as to be vertically movable while remaining in slidable contact with the rear surface of the lower crimping member. A carrier feed groove having an opening opened towards the lower crimping member is formed in said water-proof plug positioning member;

In addition, the above-mentioned object can also be attained by a method of crimping a connector terminal onto an electrical wire equipped with an elastic water-proof plug, through a crimping apparatus including an anvil and a crimper, according to the present invention, the method comprising the step of:

preparing a water-proof plug positioning member adjacent to one of the anvil and the crimper; and bringing the water-proof plug in contact with the water-proof plug positioning member and simultaneously placing the front end of the electric wire together with the elastic water-proof plug in a predetermined position with respect to the anvil and the crimper.

Further, the above-mentioned object can also be attained by an apparatus for crimping a connector terminal onto an electrical wire equipped with an elastic water-proof plug, according to the present invention, comprising:

a first upper and lower crimping members for crimping a first portion of the connecter terminal onto the end portion of the electrical wire;

a second upper and lower crimping members disposed next to the first upper and lower crimping members for crimping a second portion of the connector terminal onto the elastic water-proof plug; and a water-proof plug positioning member disposed in adjacent to the second lower crimping member for positioning the water-proof plug in a predetermined position with respect to the crimping members.

In the terminal crimping apparatus according to the present invention, a water-proof plug positioning member having a positioning protuberance used for positioning a water-proof plug in a given location with respect to the tip end of the connector terminal is provided in the vicinity of a pair of crimping members comprising upper and lower crimping members used for crimping an electrical wire and a water-proof plug in a given position on the connector terminal.

Accordingly, as a result of the water-proof plug positioning member with the positioning protuberance being brought into contact with the front end face of the water-proof plug attached to the electrical wire, the water-proof plug can be accurately placed in a given position with respect to the upper and lower crimping members.

Further, the terminal crimping apparatus is provided with a terminal positioning member which places the connector terminal in a given position with respect to the upper and lower crimping members by bringing a given area of the connector terminal substantially into contact with both surfaces of the terminal positioning member.

Therefore, the connector terminal which has been seperated from a carrier can be held in a given position with respect to the upper and lower crimping members while the connector terminal is being crimped onto the electrical wire having the water-proof plug by means of the upper and lower crimping members, so that a dimension of the connector terminal from the front end of the connector terminal to the rear end of the water-proof plug can be correctly maintained at a given value.

Further, the front end face of the water-proof plug sealing section is in contact with the rear surface of the positioning protuberance, and the upper surface of the positioning protuberance is formed into a concave circular-arc surface which is equal to the radius of the water-proof cylindrical portion. Accordingly, the electrical wire equipped with the water-proof plug can be readily positioned by moving the wire ahead from behind. Further, the electrical wire having the water-proof plug can be stably retained in the lateral direction during the crimping operation. Further, since the water-proof plug sealing section has much higher rigidity than that of the metal core of the electrical wire, the terminal crimping apparatus can be applied to an automatic assembling operation.

The water-proof plug positioning member is provided so as to be vertically movable while remaining in slidable contact with the rear surface of the lower crimping member, and the carrier feed groove having an opening opened towards the lower crimping member is formed in the water-proof plug positioning member.

Consequently, the connector terminal can be readily conveyed to a given position, and the connector terminal is removed from the carrier the instant the electrical wire is crimped on the connector terminal by means of the upper and lower crimping members, thereby resulting in improvements in working efficiency. Further, the terminal crimping apparatus can be applied to an automatic assembling operation.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, and an example of which is illustrated in the accompanying drawings.

DETAILED DESCRIPTION OF THE PREFERRED EMBODIMENTS

Figure 1:
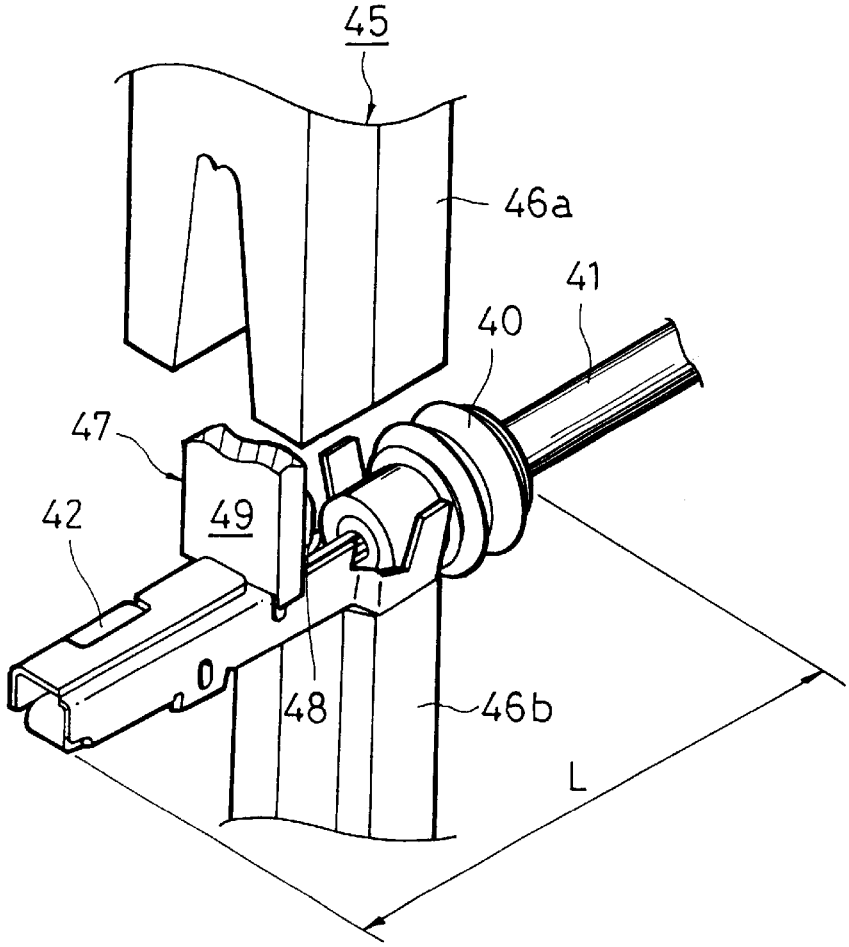
FIG.1 PRIOR ART
FIG. 1 is a perspective view showing one example of a conventional apparatus for crimping an electrical wire equipped with a water-proof plug onto a terminal.
Figure 2:
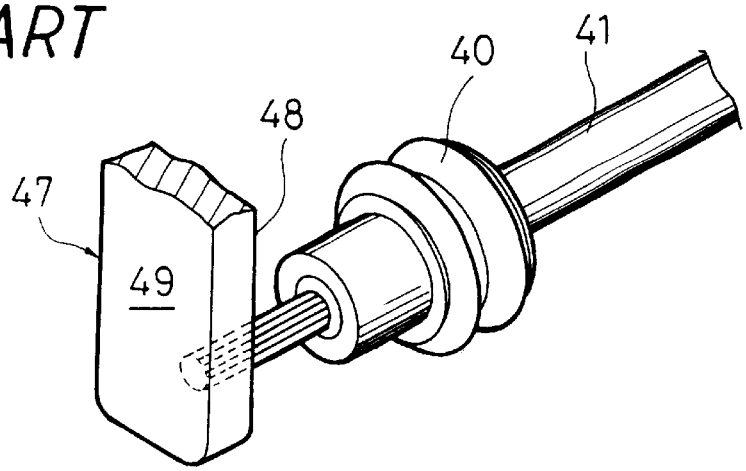
FIG.2 PRIOR ART
FIG. 2 is a diagrammatic perspective view showing the principal elements of the terminal crimping apparatus shown in FIG. 1.
Figure 3:
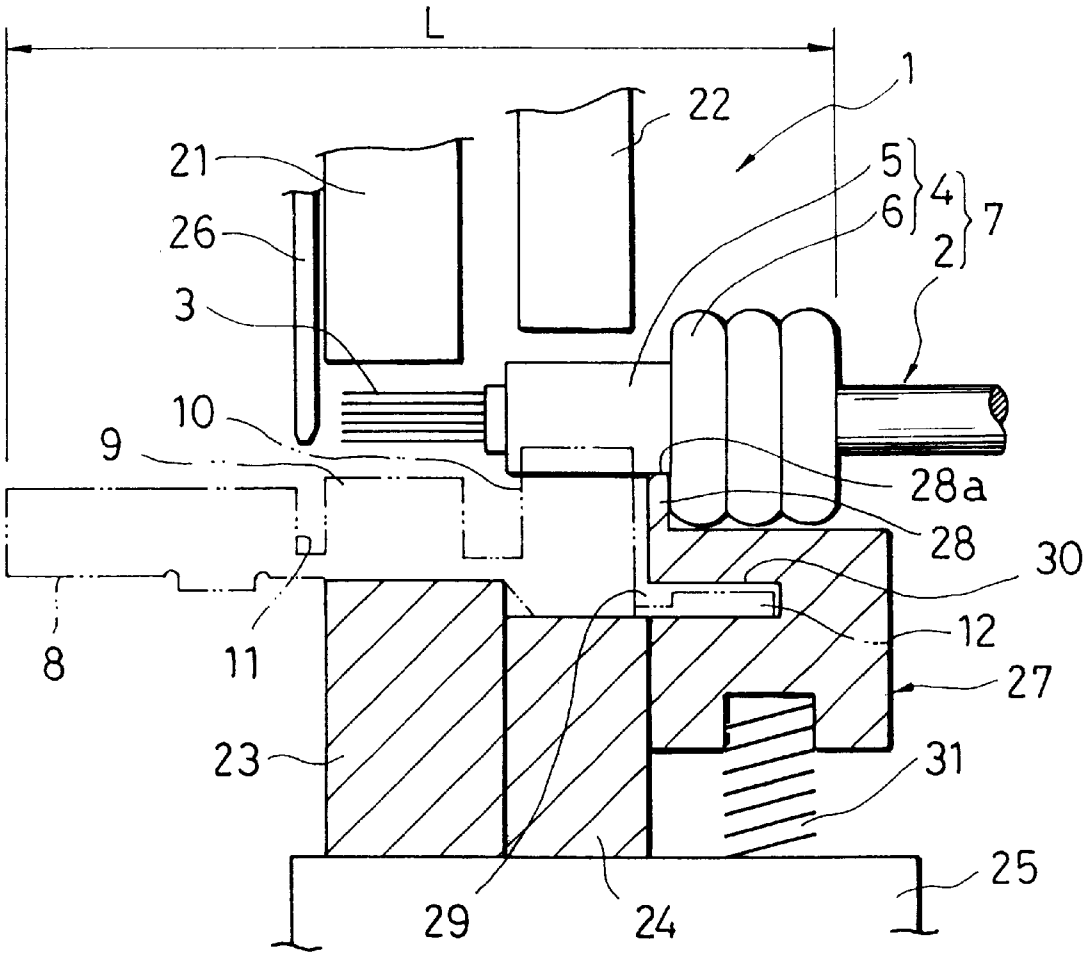
FIG. 3 is a longitudinal diagrammatic cross-sectional view showing an apparatus for crimping an electrical wire equipped with a water-proof plug onto a terminal according to one embodiment of the present invention.
Figure 4:
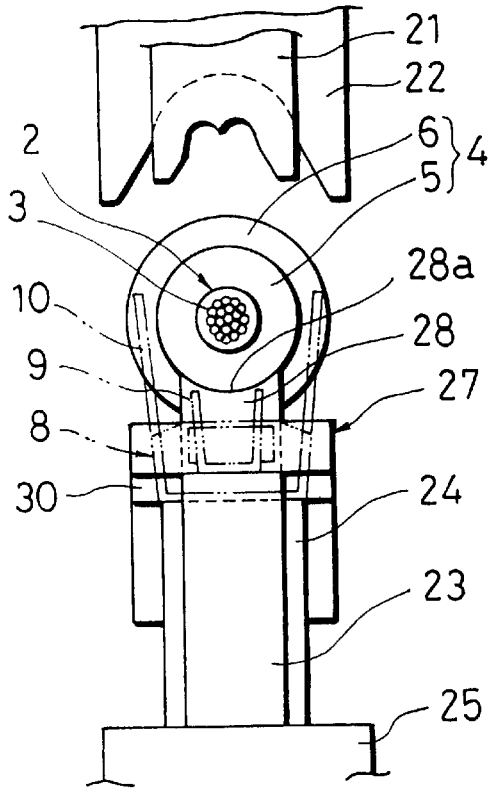
FIG. 4 is a front view showing the terminal crimping apparatus shown in FIG. 3.
Figure 5:
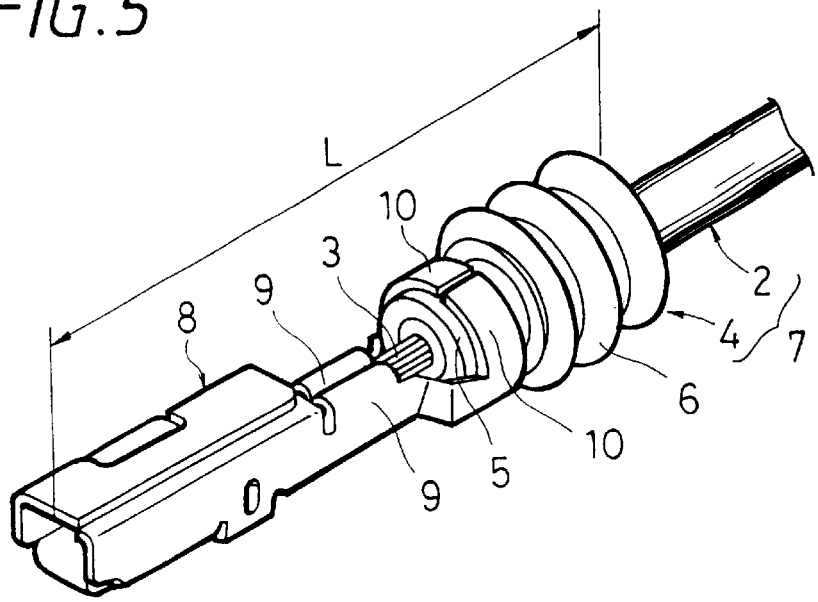
FIG. 5 is a perspective view showing a connector terminal when the electrical wire having a water-proof plug shown in FIG. 3 is crimped onto the connector terminal.

With reference to FIGS. 3 through 5, an apparatus for crimping an electrical wire equipped with a water-proof plug onto a terminal according to one embodiment of the present invention will be described in detail hereinbelow.

As shown in FIGS. 3 and 4, in a terminal crimping apparatus 1 according to an embodiment of the present invention, an electrical wire 2 is equipped with an elastic water-proof plug 4 made of rubber, or the like, and a connector terminal 8 is crimped onto the water-proof plug 4 and the electrical wire 2.

A water-proof plug positioning member 27 having a positioning protuberance 28 used for placing the water-proof plug 4 in a given position with respect to the front end of the connector terminal 8 is provided in the vicinity of upper crimping members 21, 22, which are called crimpers, and lower crimping members 23, 24, which are called anvils. The upper crimping members 21, 22 crimp an electrical wire 7 equipped with a water-proof plug (hereinafter simply referred to as a "electrical wires") in a given position on the connector terminal 8. Further, the lower crimping members 23, 24 are fixedly placed below the upper crimping members 21, 22. The lower crimping members 23, 24 are mounted on a base 25 of the terminal crimping apparatus 1. The upper and lower crimping members 21, 23 are provided in order to crimp a metal core crimping section 9 of the connector terminal 8, and the upper and lower crimping members 22, 24 are provided in order to crimp a water-proof plug crimping section 10 of the connector terminal 8.

The terminal crimping apparatus 1 further comprises a vertically-movable terminal positioning member 26. The terminal positioning member 26 is fit into a positioning groove 11 formed as a given area of the connector terminal 8 in such a way that both surfaces of the terminal positioning member 26 are substantially brought into contact with the positioning groove 11 that is the terminal positioning member 26 is centered by entering the terminal positioning member 26 into the positioning groove 11, thereby placing the connector terminal 8 in a given position with respect to the upper and lower crimping members 21, 23 and the upper and lower crimping members 22, 24.

A front portion of the water-proof plug 4 is formed into a water-proof plug cylindrical portion 5, and a rear portion of the water-proof plug 4 is formed into a water-proof plug sealing portion 6 which has a diameter larger than that of the water-proof plug cylindrical portion 5 and includes desired number of seal rings. The front end face of the water-proof plug sealing portion 6 is brought into contact with the rear surface of the positioning protuberance 28. The upper surface of the positioning protuberance 28 is formed into a concave circular-arc surface having the same radius as that of the water-proof plus cylindrical portion 5.

The positioning protuberance 28 protrudes from the upper surface of the water-proof plug positioning member 27 which is provided in such a way as to be able to vertically move while remaining in slidable contact with the rear surface of the lower crimping member 24. A carrier feed groove 30 having an opening 29 is formed in the surface of the water-proof plug positioning member 27 which faces the lower crimping member 24. The water-proof plug positioning member 27 is forced to its uppermost position by means of a spring 31 interposed between the water-proof plug positioning member 27 and the base 25.

The procedure by which the terminal crimping apparatus 1 having the foregoing structure performs a positioning operation will be described. As shown in FIGS. 3 and 4, the connector terminal 8 is placed in position on the lower crimping members 23, 24 by means of a carrier 12 while the pair of upper crimping members 21, 22 are separated from the pair of lower crimping members 23, 24. The terminal positioning member 26 is lowered to a given position from a position above the connector terminal 8 and is fitted into the positioning groove 11 in such a way that both surfaces of the terminal positioning member 26 substantially come into contact with the positioning groove 11, thereby placing the connector terminal 8 in position.

Next, the end of the electrical wire 2 is peeled off to uncover a metal core 3. An electrical wire 7, which comprises the water-proof plug 4 attached to a given position on the electrical wire 2 beforehand by means of a jig or the like, is conveyed from behind, so that the front end face of the water-proof plug sealing portion 6 comes into contact with the rear surface of the positioning protuberance 28 of the water-proof plug positioning member 27. As a result, the electrical wire 7 equipped with the electrical wire (hereinafter simply referred to as the "electrical wire") is placed in a given position on the connector terminal 8, and the metal core 3 and the water-proof plug cylindrical portion 5 are placed in position on the metal core crimping section 9 and the water-proof plug crimping section 10.

Subsequently, of the pair of upper crimping members 21, 22 and the pair of lower crimping members 23, 24, both being separated from each other, the pair of upper crimping members 21, 22 are lowered to thereby exert a pressing force onto the metal core crimping section 9 and the water-proof plug crimping section 10. As a result, the metal core crimping section 9 and the water-proof plug crimping section 10 are plastically deformed. The exposed metal core 3 of the electrical wire 2 is crimped with the metal core crimping section 9, and the water-proof cylindrical portion 5 is crimped together with the electrical wire 2 by means of the water-proof plug crimping section 10. As shown in FIG. 5, the water-proof plug 4 is consequently crimped onto the connector terminal 8.

The electrical wire 7 can be crimped onto and connected to the connector terminal 8 to a given length at all times without inducing a variation in the dimensional length L from the front end of the connector terminal 8 to the rear end of the water-proof plug 4. Since the water-proof plug positioning member 27 is lowered against the biasing force of the spring 31 during the previously-described crimping operation, the connector terminal 8 is sheared off from the carrier 12.

When the pair of upper crimping members 21, 22 are raised after the foregoing crimping and connecting operations have been completed, the water-proof plug positioning member 27 is raised to and returns to the original position by the biasing force of the spring 31. The electrical wire 7 crimped onto the connector terminal 8 can be pulled off from the terminal crimping apparatus 1 in a rearward direction by being raised to a height which is slightly greater than the thickness of the bottom plate of the connector terminal 8. In this way, the electrical wire 7 having undergone the crimping operation can be removed from the terminal crimping apparatus by solely moving it back and forth in the axial direction. For this reason, the stroke of the upper crimping members 21, 22 can be reduced, and the terminal crimping apparatus 1 can be made compact.

When the electrical wire 7 crimped onto the connector terminal 8 is fitted into an open end face of a given mount hole formed in a housing, the rear end of the water-proof plug 4 is fitted into the hole while being substantially flush with the open end face of the mount hole. Accordingly, no housing cavity is formed between the rear end of the water-proof plug 4 and the open end face of the mount hole. Therefore, a problem, such as the formation of a water puddle, can be prevented without fail, and the superior sealing characteristics of the water-proof plug can be ensured.

In the terminal crimping apparatus 1 having the foregoing electrical wire 7 according to the present embodiment, the water-proof plug positioning member 27 having the positioning protuberance 28 used for determining a given position for the water-proof plug 4 with reference to the front end of the connector terminal 8 is provided in the vicinity of the pair of upper crimping members 21, 22 and the pair of lower crimping members 23, 24, both of which crimp the electrical wire 2 and the water-proof plug 4 in a given position on the connector terminal 8.

Accordingly, as a result of the water-proof plug positioning member 27 being brought into contact with the front end of the water-proof plug sealing portion 6 of the water-proof plug 4 attached to the electrical wire 2, the water-proof plug 4 can be correctly placed in position with respect to the upper and lower crimping members 21, 22, 23, and 24.

Further, the terminal crimping apparatus 1 has the terminal positioning member 26 that is fit into a positioning groove 11 formed as a given area of the connector terminal 8 in such a way that both surfaces of the terminal positioning member 26 are substantially brought into contact with the positioning groove 11, thereby placing the connector terminal 8 in a given position with respect to the upper and lower crimping members 21, 23 and the upper and lower crimping members 22, 24.

Accordingly, the connector terminal 8 that is separated from the carrier 12 during the course of the operation for crimping the electrical wire with the water-proof plug 4 onto the connector terminal 8 by means of the upper and lower crimping members 21, 22, 23, and 24 can be placed and retained in a given position with respect to the upper and lower crimping members 21, 22, 23, and 24. Consequently, the dimension L from the front end of the connector terminal 8 to the rear end of the water-proof plug 4 can be correctly maintained at a given value.

The front end face of the water-proof plug sealing portion 6 is brought into contact with the rear surface of the positioning protuberance 28, and the upper surface of the positioning protuberance 28 is formed into a circular-arc surface 28*a* having the same radius as that of the water-proof plug cylindrical portion 5. Therefore, the electrical wire 7 can be readily placed in position by being moved from behind in a forward direction. Further, since the water-proof plug sealing portion 6 has rigidity much greater than that of the metal core of the electrical wire, the terminal crimping apparatus 1 is suitable for use in mass production which utilizes an automatic assembling operation.

Further, the water-proof plug positioning member 27 is provided so as to be able to vertically move while remaining in slidable contact with the rear surface of the lower crimping member 24, and the carrier feed groove 30 having the opening 29 is formed in the surface of the water-proof plug positioning member 27 facing the lower crimping member 24. Accordingly, the connector terminal 8 can be readily conveyed to a given position and is separated from the carrier 12 during the course of the operation for crimping the electrical wire onto the connector terminal 8 by means of the upper and lower crimping members 21, 22, 23, and 24, thereby resulting in improvements in working efficiency. Therefore, the terminal crimping apparatus can be applied to mass production which utilizes automatic assembling operation.

The dimensional length L from the front end of the connector terminal 8 to the rear end of the water-proof plug 4 can be strictly specified during the course of the foregoing manufacturing process. Therefore, there is no risk of variations in the dimensional length L, and defectives can be prevented.

For these reasons, there is no need of an operation to sort out a defective by a screening test after manufacture of an electrical wire crimped onto a connector terminal. When the connector terminal 8 is fitted into a given mount hole of a housing, the rear end of the water-proof plug 4 becomes substantially flush with the open end face of the mount hole. Accordingly, no housing cavity arises in the space between the rear end of the water-proof plug 4 and the open end face of the mount hole, thereby enabling prevention of a water paddle thoroughly. Therefore, the superior sealing characteristics of the sealing section can be ensured.

The present invention is not limited to the foregoing embodiment and can be put into practice in any other form of embodiment by making a desired modification to the present embodiment. For instance, although the water-proof plug positioning member 27 is forced in an upward direction by means of the spring 31 in the foregoing embodiment, the water-proof plug positioning member 27 may be raised or lowered in association with the movement of the upper crimping member 22 through use of a link mechanism.

As has been described above, according to the method and apparatus for crimping an electrical wire having a water-proof plug onto a connector terminal in accordance with the present invention, the water-proof plug positioning member having the positioning protuberance used for determining a given position for the water-proof plug with reference to the front end of the connector terminal is provided in the vicinity of the pair of upper crimping members and the pair of lower crimping members used for crimping the electrical wire and the water-proof plug in a given position onto the connector terminal. With this configuration, the positioning protuberance can correctly place the water-proof plug in a given position with respect to the pair of upper and lower crimping members by bringing the front end of the water-proof plug attached to the electrical wire into contact with the positioning protuberance.

Accordingly, in a case where the connector terminal is fitted into a mount hole of a housing, the rear end of the water-proof plug can be held substantially flush with the open end face of the mount hole, thereby eliminating the risk of a housing cavity occurring between the rear end of the water-proof plug and the open end face of the mount hole. A problem, such as the formation of a water puddle, can be thoroughly prevented, and the superior sealing characteristics of the water-proof plug can be ensured. Therefore, the reliability of the electrical wire having the connector terminal can be improved.

Further, the terminal crimping apparatus according to the present invention has the terminal positioning member that places the connector terminal in a given position with respect to the upper and lower crimping members by bringing the given area of the connector terminal substantially into contact with both surfaces of the terminal positioning member. By virtue of this terminal positioning member, the connector terminal, that is separated from the carrier during the operation for crimping the electrical wire having the water-proof plug onto the connector terminal through use of the upper and lower crimping members, can be placed and held in a given position with respect to the upper and lower crimping members. Accordingly, the dimensional length from the front end of the connector terminal to the rear end of the water-proof plug can be correctly maintained at a given value. Consequently, the reliability of the electrical wire having the connector terminal can be improved to a much greater extent.

Furthermore, the front end face of the water-proof plug sealing section is brought into contact with the rear surface of the positioning protuberance, and the upper surface of the positioning protuberance is formed into a circular-arch surface having the same radius as that of the water-proof plug cylindrical portion. By virtue of them, the electrical wire having the water-proof plug can be readily placed in position by being moved from behind in a forward direction. Further, the water-proof plug sealing section has much greater rigidity than that of the metal core of the electrical wire, and the terminal crimping apparatus according to the present invention is suitable for mass production which utilizes an automatic assembling operation. Therefore, it is possible to expect a reduction in manufacturing costs which would be accomplished as a result of mass production.

The water-proof plug positioning member is provided so as to be able to vertically move while remaining in slidable contact with the rear surface of the lower crimping member, and the carrier feed groove having an opening opened towards the lower crimping member is formed in the water-proof plug positioning member. Accordingly, the connector terminal can be readily conveyed to a given position, and the connector terminal is separated from the carrier during the operation for crimping the electrical wire having the water-proof plug onto the connector terminal through use of the upper and lower crimping members, thereby resulting in an improvement in working efficiency. Still further, the terminal crimping method and the terminal crimping apparatus can be applied to mass production which utilizes an automatic assembling operation. Therefore, it is possible to expect an economical advantageous result.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A method of crimping a connector terminal onto an electrical wire equipped with a water-proof plug comprising the steps of:

providing a positioning means for the electrical wire equipped with the water-proof plug;

automatically positioning the water-proof plug in a predetermined position with respect to a front end of the connector terminal through use of said positioning means; and crimping the connector terminal onto the electrical wire equipped with said water-proof plug.

2. The crimping method as defined in claim 1, wherein the electrical wire equipped with the water-proof plug set thereon approaches the connector terminal horizontally from behind and is placed in a predetermined position with respect to the front end of the connector terminal through use of the positioning means.

3. The method according to claim 1, said step of placing the water-proof plug in a predetermined position includes placing a front face of the water-proof plug adjacent to the positioning means.

4. A method of crimping a connector terminal onto an electrical wire equipped with a water-proofing plug, using a crimping apparatus including an anvil and crimper, said method comprising the steps of:

providing a water-proof plug positioning member adjacent to one of said anvil and said crimper;

bringing said water-proof plug into contact with said water-proof plug positioning member and simultaneously placing a front end of said electric wire equipped with said water-proof plug in a predetermined position with respect to said anvil and said crimper; and crimping the connector terminal onto said electrical wire equipped with said water-proof plug.

5. The method according to the claim 4, further comprising the step of:

moving said crimper towards said anvil so as to clamp said connector terminal onto said electrical wire and simultaneously cutting a part of said connector terminal by said water-proof plug positioning member.

6. The method according to claim 4, further comprising the step lowering a terminal positioning member into a positioning groove of the connector terminal in order to place the connector terminal into a position for crimping before the step of bringing said water-proof plug in contact with said water-proof plug positioning member.

7. The method according to claim 4, wherein said step of bringing said water-proof plug in contact with said water-proof plug positioning member includes placing a front end face of said water-proof plug into contact with a rear surface of a positioning protuberance of said water-proof plug positioning member.

8. The method according to claim 4, further comprising the steps of:

placing a carrier of said connector terminal into a carrier feed groove of said water-proof plug positioning member before said step of bringing said water-proof plug in contact with said water-proof plug positioning member; and lowering said water-proof plug positioning member to shear off the carrier of said connector terminal during said crimping step.

* * * * *